US005454737A

United States Patent [19]

Saba

[11] Patent Number: 5,454,737

[45] Date of Patent: Oct. 3, 1995

[54] RELAY CONNECTOR

[75] Inventor: Toshikazu Saba, Yokkaichi, Japan

[73] Assignee: Sumitomo Wiring Systems, Ltd., Japan

[21] Appl. No.: 301,330

[22] Filed: Sep. 6, 1994

[30] Foreign Application Priority Data

Sep. 30, 1993 [JP] Japan ..... 5-269516

[51] Int. Cl.[6] ..... H01R 25/00

[52] U.S. Cl. ..... 439/655; 439/350; 439/552

[58] Field of Search ..... 439/549–555, 439/569, 650, 654–655, 350

[56] References Cited

U.S. PATENT DOCUMENTS

| | | | |
|---|---|---|---|
| 3,989,343 | 11/1976 | Lucius et al. | 339/248 |
| 4,148,545 | 4/1979 | Kies | 439/655 |
| 4,243,289 | 1/1981 | Kozel | 439/655 |
| 4,408,820 | 10/1983 | Eaby et al. | 439/655 |
| 5,096,434 | 3/1992 | Byrne | 439/654 |
| 5,263,871 | 11/1993 | Sano | 439/549 |
| 5,316,489 | 5/1994 | Kachlic et al. | 439/569 |
| 5,334,049 | 8/1994 | Kachlic et al. | 439/552 |

FOREIGN PATENT DOCUMENTS 29186 8/1992 Japan .

*Primary Examiner*—Larry I. Schwartz
*Assistant Examiner*—Jill DeMello
*Attorney, Agent, or Firm*—Jordan B. Bierman; Bierman and Muserlian

[57] ABSTRACT

A connector which can be easily attached to a vehicle body and causes no failure or breakage of wires. The connector has a connector housing, including a front socket portion and a rear socket portion. Upon attaching the connector to the vehicle body, it is easy to position the rear socket portion thereby making installation efficient and hence inexpensive. There is no need for assembling a subharness. Since a transfer portion is provided in the connector housing, there is no breakage or damage of wires during attachment.

2 Claims, 5 Drawing Sheets

RELAY CONNECTOR

BACKGROUND OF THE INVENTION

1. Field of the Invention

This invention relates to an awaiting connector and more particularly to an awaiting connector adapted to be attached to a vehicle body.

2. Statement of the Prior Art

For convenience of explanation, a conventional awaiting connector will be described below by referring to FIG. 7. FIG. 7 is a schematic side elevational view of the conventional awaiting connector.

As shown in FIG. 7, an awaiting connector 1 is provided on its end with a hood 2 which is adapted to receive a mating connector. The awaiting connector 1 accommodates terminal members 4 which are inserted into the connector 1 from its other end and connected to electrical wires 3. The hood 2 is provided on its outer periphery with an engaging member 6 which is adapted to be attached to a vehicle body when the hood 2 is inserted into an engaging hole 5 in the vehicle body.

In the case of wiring for a body of an automotive vehicle, if a door harness side connector 7 connected to electrical devices in a door and a main harness side connector 8 in a vehicle interior are prepared, the awaiting connector 1 must be connected to another connector 9 through the electrical wires 3 to form a subharness.

Upon attaching the subharness to the vehicle body, after the connector 9 is inserted into the engaging hole 5 in the vehicle body to be pushed into the vehicle interior, the awaiting connector 1 is inserted into the engaging hole 5 and secured by the engaging member 6. Thereafter, the door harness side connector 7 is coupled to the awaiting connector 1 while the main harness side connector 8 is coupled to the connector 9 of the subharness in the vehicle interior.

In the conventional awaiting connector described above, it is necessary to complete the subharness by connecting the connector 9 to the awaiting connector 1. A step of completing an independent harness requires much labor. Also, when the subharness is attached to the vehicle body, the connector 9 which is connected through the electrical wires 3 to the awaiting connector 1 in a dangling state must be inserted into the vehicle interior. In the case where the connector 9 must be passed through two wall members of the vehicle body, attachment of the connector 9 requires much labor. Since intermediate electrical wires may contact a corner of the wall members of the vehicle body, they may break or short-circuit.

SUMMARY OF THE INVENTION

An object of the present invention is to provide an awaiting connector which can easily connect a vehicle body outside harness and a vehicle body inside harness and causes no breakage of wires.

In order to achieve the above object, an awaiting connector wherein a connector housing is provided on its exterior with an engaging portion to be attached to a support of a vehicle body, in accordance with the present invention, is characterized in that said connector housing includes a plurality of socket portions which accommodate a plurality of fitting terminal members and receive a mating connector detachably, and a transfer portion which is provided between the socket portions and interconnects the respective fitting terminal members in the respective socket portions.

In the above awaiting connector, the transfer portion is formed in the housing so that the socket portions are opposed to any desired directions relative to the support of the vehicle body.

In the above awaiting connector, a single connector housing is provided with a plurality of socket portions. The connector housing can be attached to the support of the vehicle body by the engaging member. Thus, a plurality of socket portions are mounted on the vehicle body at the same time. Since the respective fitting terminal members in the respective socket portions are interconnected through the transfer portion, the respective mating connectors are electrically connected if the respective mating connectors are coupled to the respective socket portions.

Also, in the above awaiting connector, when the single connector housing is attached to the support of the vehicle body, a plurality of socket portions are faced to any desired direction, respectively. Accordingly, for example, it is possible to provide both vehicle body outside and inside connectors in the vehicle body so as to face the socket portions in a direction in which each connector can be easily mounted on the vehicle body.

According to the present invention, it is possible to reduce mounting labor since a plurality of connectors are interconnected by merely attaching the single connector housing to the vehicle body. In particular, it is possible to reduce the number of parts and to lower the cost of working since a conventional harness is not required. Since the respective fitting terminal members are interconnected electrically in the connector housing, the members are not subject to damage upon mounting.

Since the socket portions are faced to the direction in which the mating connector can be easily coupled to the awaiting connector, working efficiency can be greatly enhanced.

DETAILED DESCRIPTION OF THE PREFERRED EMBODIMENTS

Figure 1:
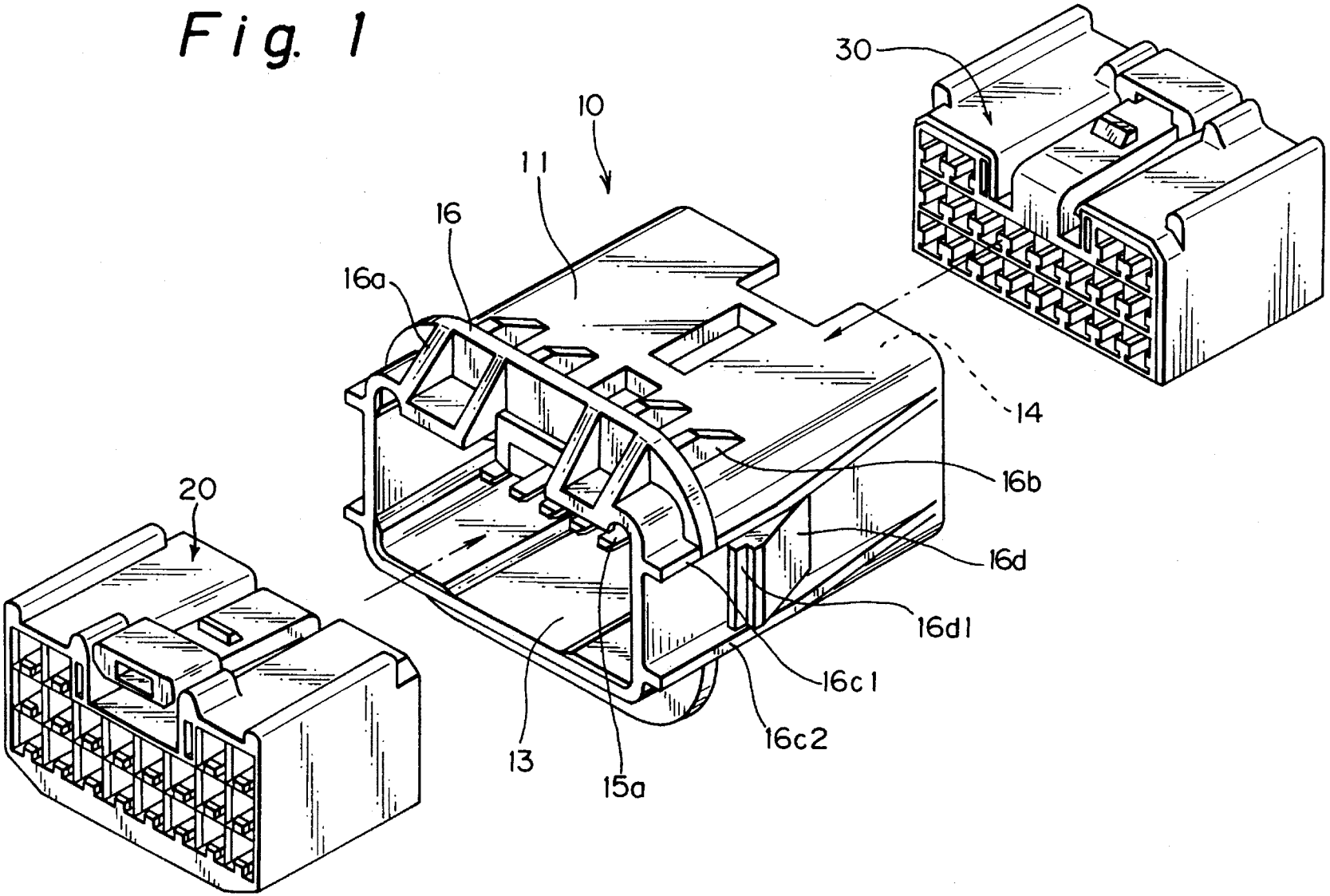
FIG. 1 is an exploded perspective view of an embodiment of an awaiting connector of the present invention and mating connectors.
Figure 2:
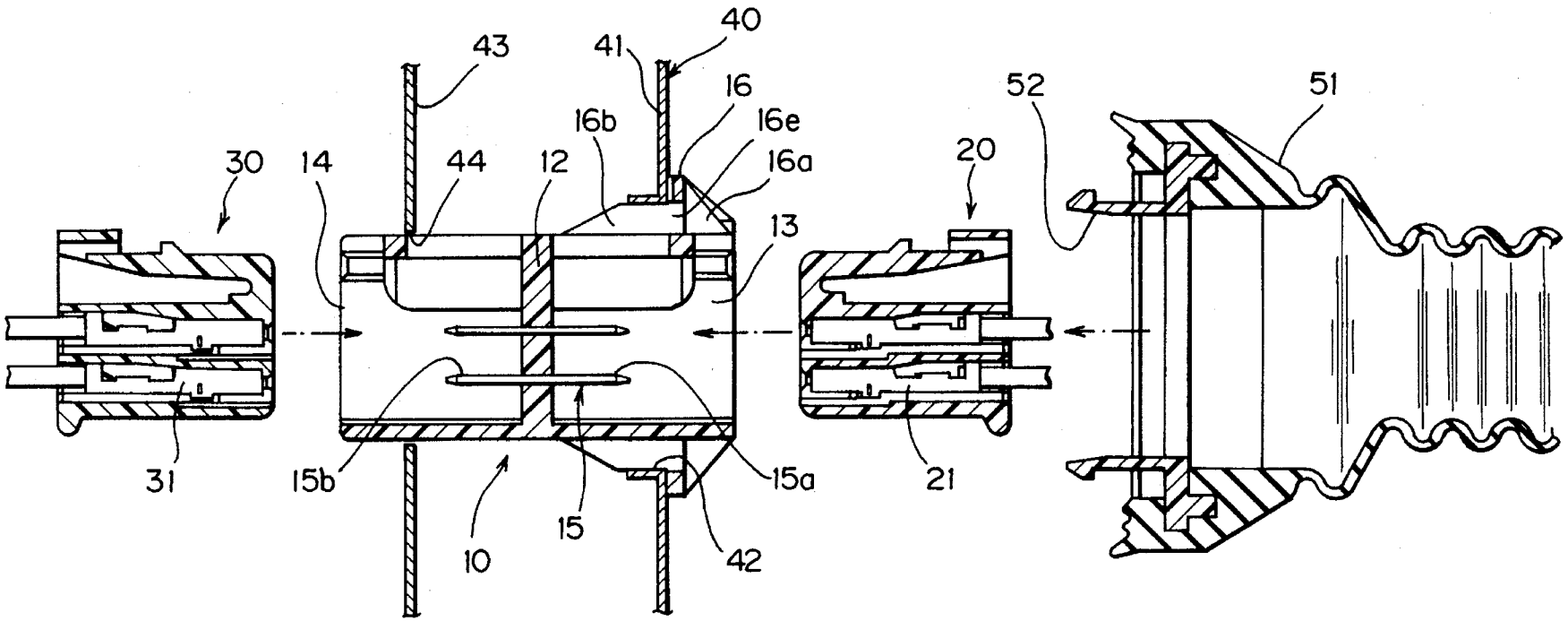
FIG. 2 is a longitudinal sectional view illustrating an assembling procedure of each connector shown in FIG. 1.
Figure 3:
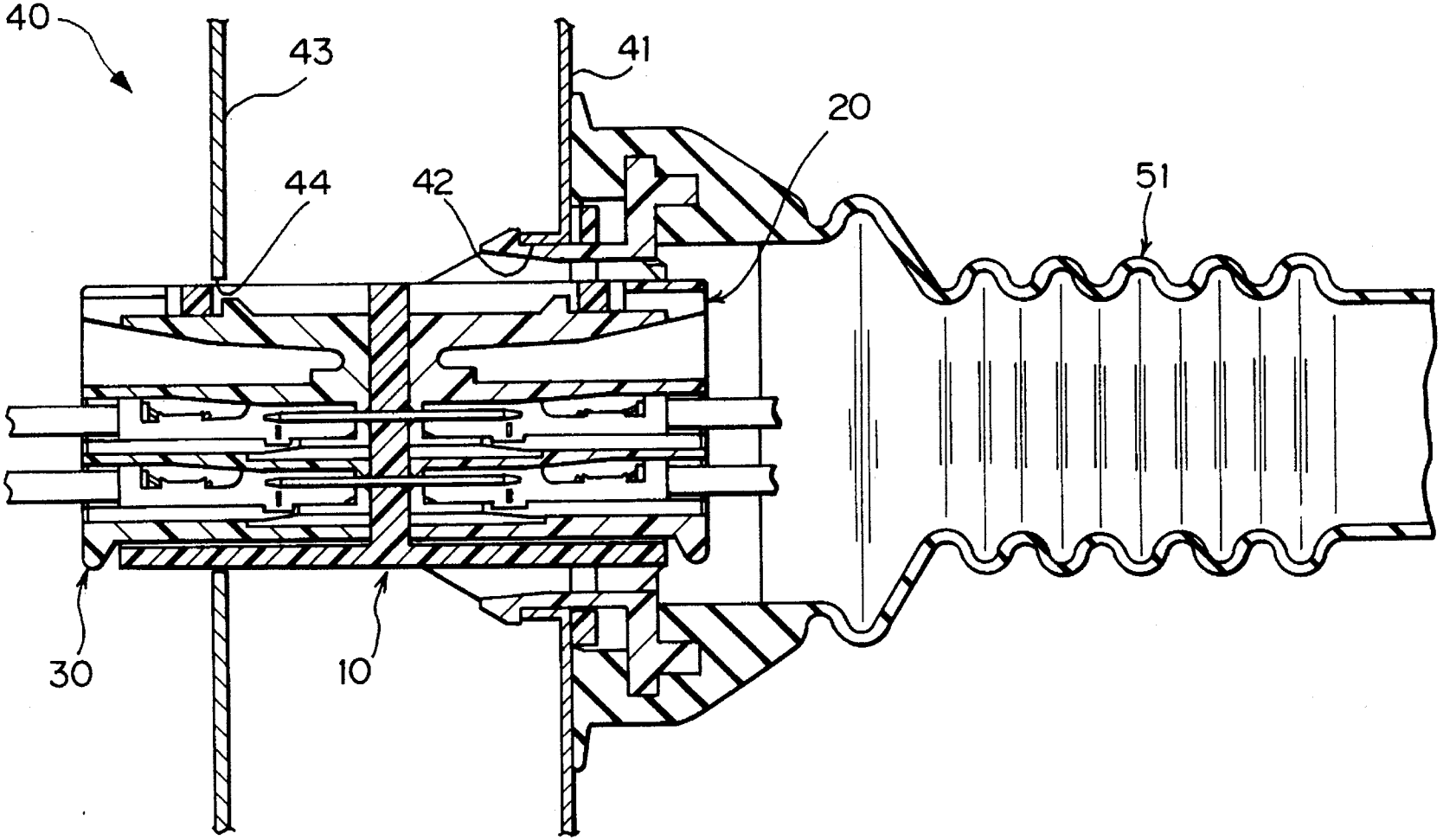
FIG. 3 is a longitudinal sectional view illustrating an assembled state of each connector shown in FIG. 2.
Figure 4:
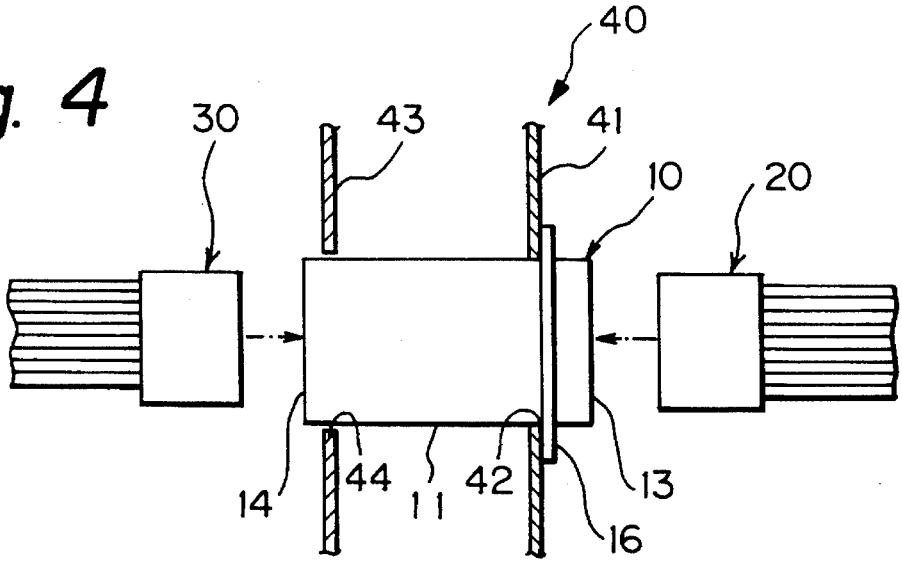
FIG. 4 is a side elevational view illustrating an assembling procedure of each connector.

An embodiment of an awaiting connector of the present invention will be described below by referring to the drawings.

In FIGS. 1 to 4, an awaiting connector 10 has a single connector housing 11 which is a general cylindrical shape and is provided in its intermediate portion with a partition 12 to form a transfer portion. A front side socket portion 13 and a rear side socket portion are formed on opposite sides of the partition 12 in the connector housing 11. The partition 12 supports a plurality of plate like metal terminals 15 in a manner of press-insert or molding-insert. The metal terminals 15 become fitting terminal member 15*a* in the front side socket portion 13 and fitting terminal member 15*b* in the rear side socket portion 14. The members 15*a* and 15*b* are interconnected through a portion supported in the partition 12.

The front side socket portion 13 in the connector housing 11 is provided on its upper and lower sides with flanges 16. The flange 16 is provided on its front sides with reinforcing ribs 16*a* and on its rear sides with guide ribs 16*b* which are inclined rearwardly.

On the other hand, the connector housing 11 is provided on its opposite sides with guide ribs 16*cl* and 16*c*2 which project rearwardly from the side face on the connector housing 11 and are spaced in the height direction in parallel with each other. The connector housing 11 is provided between the guide ribs 16*cl* and 16*c*2 on the opposite sides with lock pieces 16*d* which can elastically deflect inwardly and outwardly. The lock piece 16*d* projects over the guide ribs 16*cl* and 16*c*2 at the front side. The lock piece 16*d* is provided on its front end with a stepped portion 16*d*1 which is lower than the guide ribs 16*c*1 and 16*c*2.

A door harness side connector 20 is adapted to be inserted into the front side socket portion 13 and holds female fitting terminal members 21 adapted to be coupled to the fitting terminal members 15*a* projecting in the front side socket portion 13. On the other hand, a main harness side connector 30 is adapted to be inserted into the rear side socket portion 14 and holds female fitting terminal members 31 adapted to be coupled to the fitting terminal members 15*b* projecting in the rear socket portion 14.

An outer wall 41 of a vehicle body 40 is provided with an engaging hole 42 which is larger than the exterior of the connector housing 11 so that the guide ribs 16*b*, 16*cl* and 16*c*2 can pass through the hole 42. An inner wall 43 is provided with a hole 44 which is slightly larger than the outer periphery of the connector housing 11. A door harness to which the connector 20 is attached passes through a waterproofing grommet 51. The grommet 51 is provided with an open end which is adapted to closely contact with the outer wall 41 to enclose the engaging hole 42. Further, the grommet 51 has grommet holders 52 adapted to fit in engaging apertures 16*e* in the flange 16.

Next, a manner of using the awaiting connector constructed above will be explained below.

Assembling of the awaiting connector 10 is finished by merely press-inserting the metal terminals 15 into the partition 12 of the connector housing 11. The connector 10 is inserted into the engaging hole 42 in the outer wall 41 of the vehicle body 40 with the rear side socket portion 14 being directed to the hole 41. Since the exterior of the housing 11 is smaller than the engaging hole 42, the housing 11 easily enters into the hole 42. When the connector housing 11 is gradually entering into the hole 42, the guide ribs 16*cl*, 16*c*2 and 16*b* of the housing 11 contact with the edge of the hole 42 at their ramps, thereby guiding the housing 11 to the center of the hole 42.

When the flange 16 approaches the wall 41, the lock pieces 16d contact with the side edges of the engaging hole 42. The lock pieces 16*d* is deflected inwardly to allow the housing 11 to be inserted into the hole 42. When the flange 16 contacts with the wall 41, the stepped portion 16*d*1 of the lock piece 16*d* faces the edge of the hole 42 and the lock piece 16*d* returns outwardly so that the stepped portion 16*d*1 engages with the edge of the hole 42.

On the other hand, since the rear socket portion 14 is united to the front socket portion 13 in the connector housing 11, the housing 11 smoothly enters into the hole 44 in the inner wall 43 of the vehicle body 40, so long as the front socket portion 13 is positioned properly in the hole 42. That is, the rear side socket portion 14 is smoothly inserted into the hole 44 in the wall 43 without any dangling as occurs in the prior art.

After the awaiting connector 10 is attached to the vehicle body 40, the door harness side connector 20 is inserted into the front socket portion 13 to couple the terminal members to each other in connection with a progress in assembling of the vehicle body and the main harness side connector 30 is inserted into the rear socket portion 14 to couple the terminal members to each other.

Figure 5:
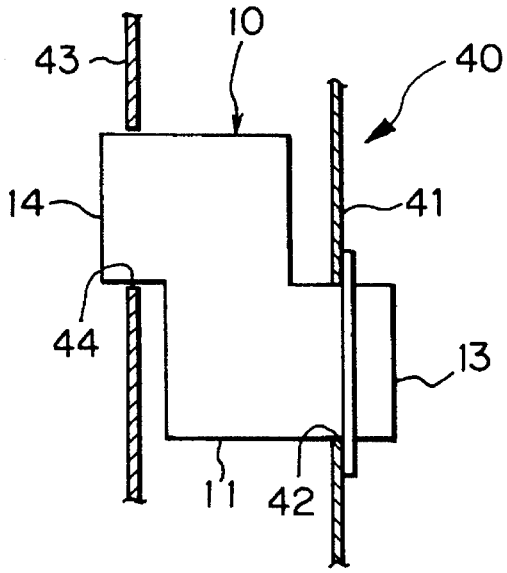
FIG. 5 is a schematic longitudinal sectional view of another embodiment of the awaiting connector of the present invention.
Figure 6:
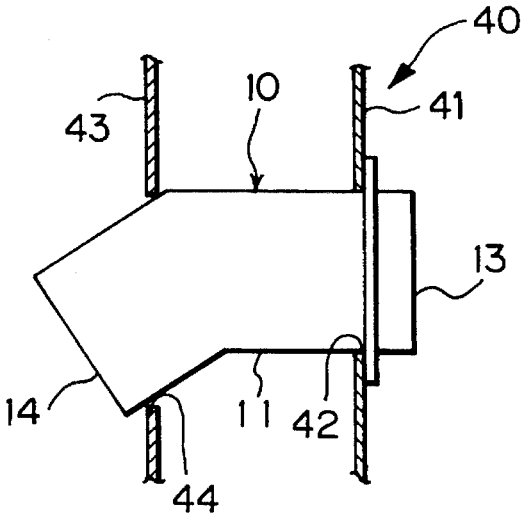
FIG. 6 is a schematic longitudinal sectional view of still another embodiment of the awaiting connector of the present invention.
Figure 7:
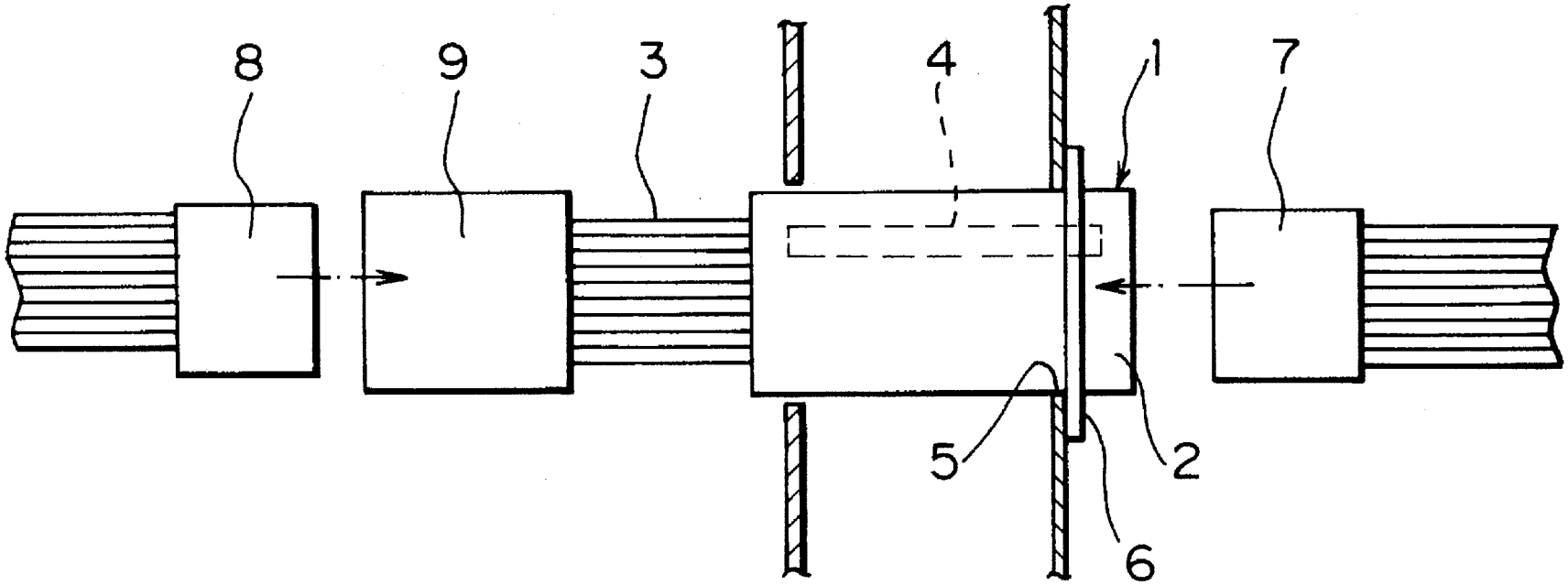
Fig. 7 PRIOR ART
FIG. 7 is a schematic side elevational view of a conventional awaiting connector.

FIGS. 5 and 6 show another embodiments of an awaiting connector of the present invention.

In the embodiment shown in FIG. 5, the engaging hole 42 in the outer wall 41 of the vehicle body 40 is displaced downwardly from the engaging hole 44 in the inner wall 43. It is possible to insert the rear socket portion 14 into the hole 44 by forming the transfer portion of the connector housing 11 into a crank like shape and by positioning the front side socket portion 13. Accordingly, it is very easy to attach the connector to the vehicle body.

On the other hand, in the embodiment shown in FIG. 6, the axis of the connector 20 is set to be an angle relative to the axis of the connector 30. The connector 30 is easily inserted into the rear socket portion 14 by bending the transfer portion and the portion 14.

Thus, it is possible to easily position the rear socket portion 14 in the hole 44 and to eliminate the subharness, since the front and rear socket portions 13 and 14 are provided in the single connector housing 11. Also, since the transfer portion is disposed in the connector housing 11, the terminal members and electrical wires are not subject to breakage or damage.

Although the two socket portions are provided in the above embodiments, more than three socket portions may be provided.

What is claimed is:

1. A relay connector comprising a generally cylindrical hollow housing extending in a longitudinal direction, a partition in said housing transverse to said longitudinal direction dividing said hollow housing into a front portion and a rear portion, a plurality of terminals secured intermediate their ends by said partition and extending in said longitudinal direction into said front portion and said rear portion, said front portion being open at a front face remote from said partition, and said rear portion being open at a rear face remote from said partition, said ends constituting front connections and rear connections, a front unit having a plurality of front sockets in said front portion, each of said front sockets mating with one of a plurality of said ends, a rear unit having a plurality of rear sockets in said rear portion, each of said rear sockets mating with another of a plurality of said ends, a flange on an exterior of said housing mounted on a vehicle body, said rear portion being open in one direction and said front portion being open in an opposite direction to said one direction, a recess on an interior of said housing, a complementary projection on an outside of said rear unit, said projection in said recess, whereby said rear unit is releasably locked to said housing, a grommet fitting surrounding the front of said housing and releasably locked thereto, thereby securing said front unit in said front portion.

2. The connector of claim 1 wherein said housing extends through both an inner wall and an outer wall of said vehicle, said housing being mounted on said inner wall or said outer wall, whereby said rear face is open to a passenger compartment of said vehicle and said front face is open to a door of said vehicle.

* * * * *